US012098874B1

(12) United States Patent
Li

(10) Patent No.: US 12,098,874 B1
(45) Date of Patent: Sep. 24, 2024

(54) ICE CUBE REMOVAL TOOL

(71) Applicant: Wanzhen Li, Zhejiang (CN)

(72) Inventor: Wanzhen Li, Zhejiang (CN)

( * ) Notice: Subject to any disclaimer, the term of this patent is extended or adjusted under 35 U.S.C. 154(b) by 0 days.

(21) Appl. No.: 18/420,196

(22) Filed: Jan. 23, 2024

(30) Foreign Application Priority Data

Dec. 13, 2023 (CN) ..... 202323391826.9

(51) Int. Cl.
*F25C 1/243* (2018.01)

(52) U.S. Cl.
CPC ..... *F25C 1/243* (2013.01)

(58) Field of Classification Search
CPC ..... F25C 5/02; F25C 5/06; F25C 1/24; F25C 1/243; F25C 1/246
See application file for complete search history.

(56) References Cited

U.S. PATENT DOCUMENTS 2,772,542 A * 12/1956 Gaugler ..... F25C 5/182 249/70
3,135,101 A * 6/1964 Nigro ..... F25C 5/185 D15/90
3,159,985 A * 12/1964 Keighley ..... F25C 5/185 62/344
3,226,939 A * 1/1966 Harbison ..... F25C 5/18 62/177
3,398,552 A * 8/1968 Pietrzak ..... F25C 5/185 62/320
3,412,572 A * 11/1968 Kesling ..... F25C 1/243 62/344
3,653,224 A * 4/1972 Tsen ..... F25C 5/185 62/344
3,670,523 A * 6/1972 Fogt ..... F25C 1/243 249/126
3,677,030 A * 7/1972 Nicholas ..... F25C 1/04 62/353
3,803,868 A * 4/1974 Tunzi ..... F25C 1/243 62/320
4,142,377 A * 3/1979 Fogt ..... F25C 1/04 62/353
4,789,130 A * 12/1988 Stich ..... F25C 1/243 249/126
4,804,083 A * 2/1989 Weeks ..... F25C 1/243 215/47
4,883,251 A * 11/1989 Manas ..... F25C 1/24 249/126
4,967,995 A * 11/1990 Burgess ..... F25C 1/24 249/70
5,044,600 A * 9/1991 Shannon ..... F25C 1/243 249/120
5,261,468 A * 11/1993 Scheel ..... B67C 11/00 141/334

(Continued)

*Primary Examiner* — Emmanuel S Luk
(74) *Attorney, Agent, or Firm* — Hawaii Patent Services; Nathaniel K. Fedde; Kenton N. Fedde

(57) ABSTRACT

The present disclosure provides an ice cube removal tool, including an ice cube removal main body for containing an ice cube mold. The ice cube removal main body is provided with an ice cube twisting part capable of being turned relative to the ice cube removal main body, the ice cube removal main body and the ice cube twisting part are partially limited and fixed to the ice cube mold respectively, and during the process of removing ice cubes, the ice cube twisting part is turned to twist and deform the ice cube mold and allow the ice cubes to be removed.

16 Claims, 5 Drawing Sheets

(56) References Cited

U.S. PATENT DOCUMENTS

D352,045 S * 11/1994 Daenen ..... F25C 1/24 D15/90
10,697,686 B2 6/2020 Braidotti Cavalari
11,085,687 B2 8/2021 Leal
11,098,939 B2 * 8/2021 Pfeiffer ..... F25C 5/04
11,098,940 B2 8/2021 Finell
11,953,255 B2 * 4/2024 Ryu ..... F25C 5/24
2005/0151049 A1 * 7/2005 Lion ..... F25C 1/24 249/127
2006/0032262 A1 * 2/2006 Seo ..... F25C 5/06 62/340
2007/0164192 A1 * 7/2007 Holden ..... F25C 1/243 249/98
2011/0278430 A1 * 11/2011 Barno ..... F25C 1/243 249/70
2011/0296863 A1 * 12/2011 Bergqvist ..... F25C 1/10 62/340
2013/0291583 A1 * 11/2013 Bauman ..... F25C 1/24 62/340
2014/0260406 A1 * 9/2014 Tenbarge ..... F25C 5/06 62/340
2015/0338146 A1 * 11/2015 Keller ..... F25C 1/04 62/139
2016/0116198 A1 * 4/2016 Becker ..... F25C 5/06 62/344
2017/0299244 A1 * 10/2017 Alshourbagy ..... F25C 5/06
2017/0336124 A1 * 11/2017 Visin ..... F25C 1/243
2018/0245832 A1 * 8/2018 Ji ..... F25C 5/04
2019/0068032 A1 * 2/2019 Saito ..... F25C 5/06
2019/0271496 A1 * 9/2019 Sigmund ..... F25C 5/06
2021/0222936 A1 * 7/2021 Larson ..... F25C 1/24
2021/0364212 A1 11/2021 Wagner
2021/0389039 A1 12/2021 Hutchins
2022/0235990 A1 7/2022 Li
2023/0375245 A1 * 11/2023 Ryu ..... F25C 1/25

* cited by examiner

ICE CUBE REMOVAL TOOL

CROSS-REFERENCE TO RELATED APPLICATION

The application claims priority of Chinese patent application CN 202323391826.9, filed on Dec. 13, 2023, which is incorporated herein by reference in its entireties.

TECHNICAL FIELD

The present disclosure relates to the field of ice cube making, and particularly relates to an ice cube removal tool.

BACKGROUND

An ice cube removal tool is a tool used for removing ice cubes in an ice cube mold.

As the standard of living is continuously improved, drinking cold drinks with ice cubes has become a fashion trend. More and more families are equipped with ice cube molds for making ice cubes, among which the popular ice cube molds may refer to ice cube molds disclosed in the patents such as CN308122310S, CN306766809S and CN306676867S. During the process of using such an ice cube mold, water is usually poured into an ice cube tray, the ice cube tray is flipped after water is frozen, and the ice cube tray is pressed and deformed to free ice cubes therein. The main principle of this ice cube mold is to free ice cubes by deformation, which can refer to ice cube removal tools disclosed in the patents such as CN219607445U, CN216953655U and CN220103473U.

However, some defects or aspects that need to be improved exist in ice cube removal tools corresponding to the above-mentioned ice cube molds; such ice cube molds are generally pressed to free ice cubes with great effort; the ice cube mold also needs a corresponding support structure, thereby being complex in structure; during the operation, the mold needs to be flipped, corresponding ribs and grooves need to be aligned, and the operation process is cumbersome.

Therefore, the present disclosure will propose a solution to the above technical problem.

SUMMARY

The present disclosure aims to provide an ice cube removal tool, and an ice cube mold is twisted and deformed to free ice cubes, thereby being more convenient to operate with less effort and more concise in tool structure.

To achieve the goal, the present disclosure provides a technical solution: an ice cube removal tool, including an ice cube removal main body for containing an ice cube mold. The ice cube removal main body is provided with an ice cube twisting part capable of being turned relative to the ice cube removal main body, the ice cube removal main body and the ice cube twisting part are partially limited and fixed to the ice cube mold respectively, and during the process of removing ice cubes, the ice cube twisting part is turned to twist and deform the ice cube mold and allow the ice cubes to be removed.

In the aforementioned ice cube removal tool, the ice cube removal main body is provided with an ice cube receiving and storage chamber for receiving and storing removed ice cubes.

In the aforementioned ice cube removal tool, the ice cube receiving and storage chamber is provided with an ice cube outlet, and the removed ice cubes are poured out from the ice cube outlet.

In the aforementioned ice cube removal tool, the ice cube outlet is an axial ice cube outlet which is formed on a bottom side of the ice cube receiving and storage chamber.

In the aforementioned ice cube removal tool, the caliber of the axial ice cube outlet of the ice cube removal main body is less than the width of the ice cube mold, thereby preventing the ice cube mold from coming out of the axial ice cube outlet.

In the aforementioned ice cube removal tool, the axial ice cube outlet of the ice cube removal main body is necked down.

In the aforementioned ice cube removal tool, a corresponding cover lid is arranged on the ice cube outlet.

In the aforementioned ice cube removal tool, the ice cube outlet is a radial ice cube outlet formed on the circumferential side of the ice cube receiving and storage chamber.

In the aforementioned ice cube removal tool, the ice cube removal main body has a cylindrical sidewall.

In the aforementioned ice cube removal tool, the ice cube removal main body is at least partially limited and fixed to a bottom end of the ice cube mold.

In the aforementioned ice cube removal tool, the ice cube removal main body is provided with limiting ribs corresponding to the bottom end of the ice cube mold, and the ice cube removal main body twists the ice cube mold through the limiting ribs to deform the ice cube mold.

In the aforementioned ice cube removal tool, the four limiting ribs are uniformly and symmetrically distributed on the ice cube removal main body.

In the aforementioned ice cube removal tool, the ice cube removal main body is provided with a radial opening, and the ice cube mold is placed into the ice cube removal main body through the radial opening.

In the aforementioned ice cube removal tool, the ice cube twisting part is provided with limiting grooves corresponding to the edge of the ice cube mold, and when the ice cube mold is placed into the ice cube removal main body through the radial opening, the ice cube twisting part twists the ice cube mold through the limiting grooves to deform the ice cube mold.

In the aforementioned ice cube removal tool, the two limiting grooves are arranged on the ice cube twisting part in a cross-shaped mode.

In the aforementioned ice cube removal tool, groove openings of the limiting grooves at least partially extend to the positions aligned with the radial opening, and the ice cube mold can be directly mounted into the limiting grooves through the radial opening.

In the aforementioned ice cube removal tool, the limiting grooves are flared out.

In the aforementioned ice cube removal tool, the ice cube twisting part is at least partially limited and fixed to a top end of the ice cube mold.

In the aforementioned ice cube removal tool, the ice cube twisting part is provided with an axial opening, and the ice cube mold is placed into the ice cube removal main body through the axial opening.

In the aforementioned ice cube removal tool, a limiting step corresponding to the edge of the ice cube mold is formed in the axial opening, and the ice cube twisting part can twist the ice cube mold through the limiting step to deform the ice cube mold.

In the aforementioned ice cube removal tool, an ice cube mold outlet hole is formed in the axial opening.

In the aforementioned ice cube removal tool, a convex ring and a ring groove, which correspond with each other, are arranged between the ice cube twisting part and the ice cube removal main body for connection, and the ice cube twisting part and the ice cube removal main body are turned through the convex ring and the ring groove.

Compared with the prior art, the present disclosure has the prominent and beneficial technical effects:

the ice cube removal tool is provided with the ice cube removal main body and the ice cube twisting part, and the mold is twisted and deformed to free ice cubes; compared with an existing ice cube box, there is no need to flip an ice plate and align ribs, grooves, etc., operating steps are concise, ice cubes can be taken out conveniently and easily without hard pressing, and the tool is simple in overall structure, convenient to assemble and low in cost.

BRIEF DESCRIPTION OF THE DRAWINGS

The accompanying drawings, which constitute a part of this application, are used for providing a further understanding of the present disclosure; and schematic embodiments of the present disclosure and descriptions thereof are intended to explain the present disclosure and are not construed to unduly limit the present disclosure. In the drawings.

Figure 1:
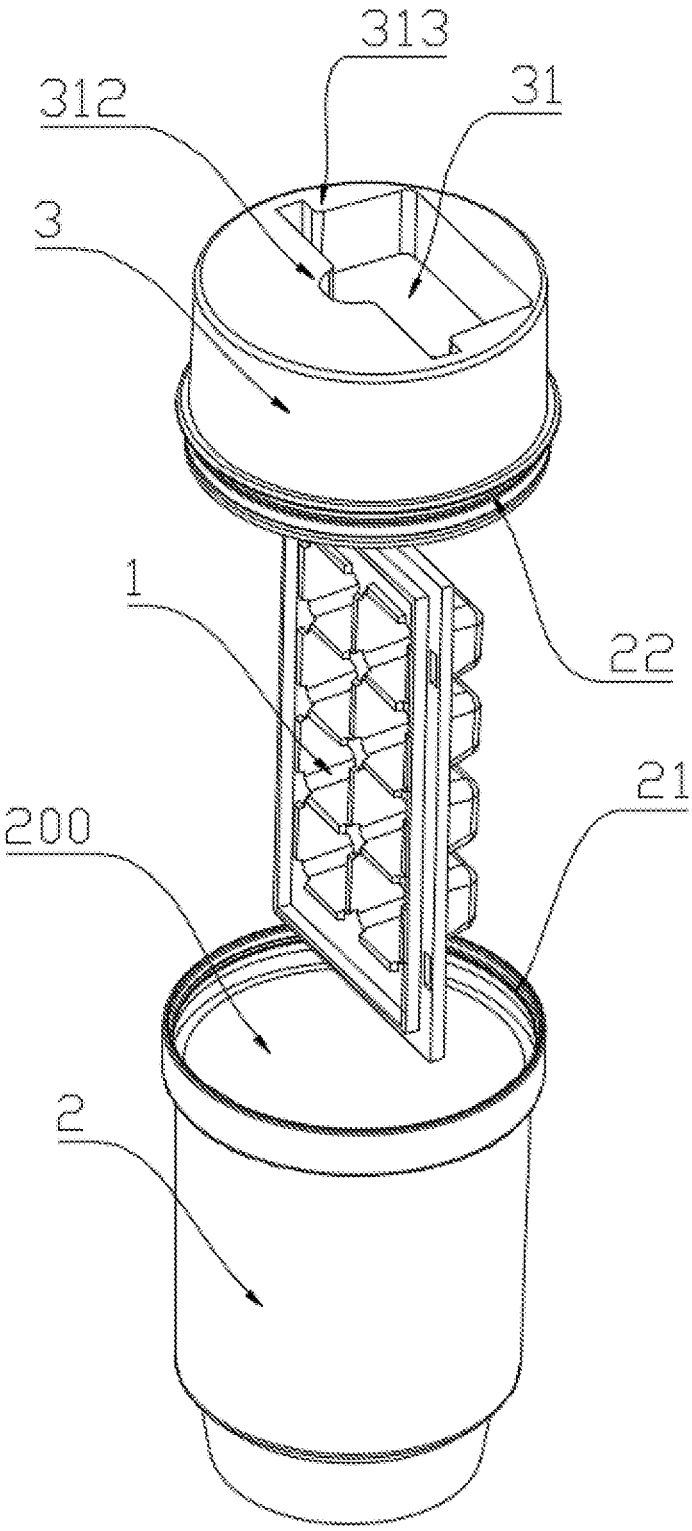
FIG. 1 is an exploded structural schematic view I of an ice cube removal tool according to the present disclosure.
Figure 2:
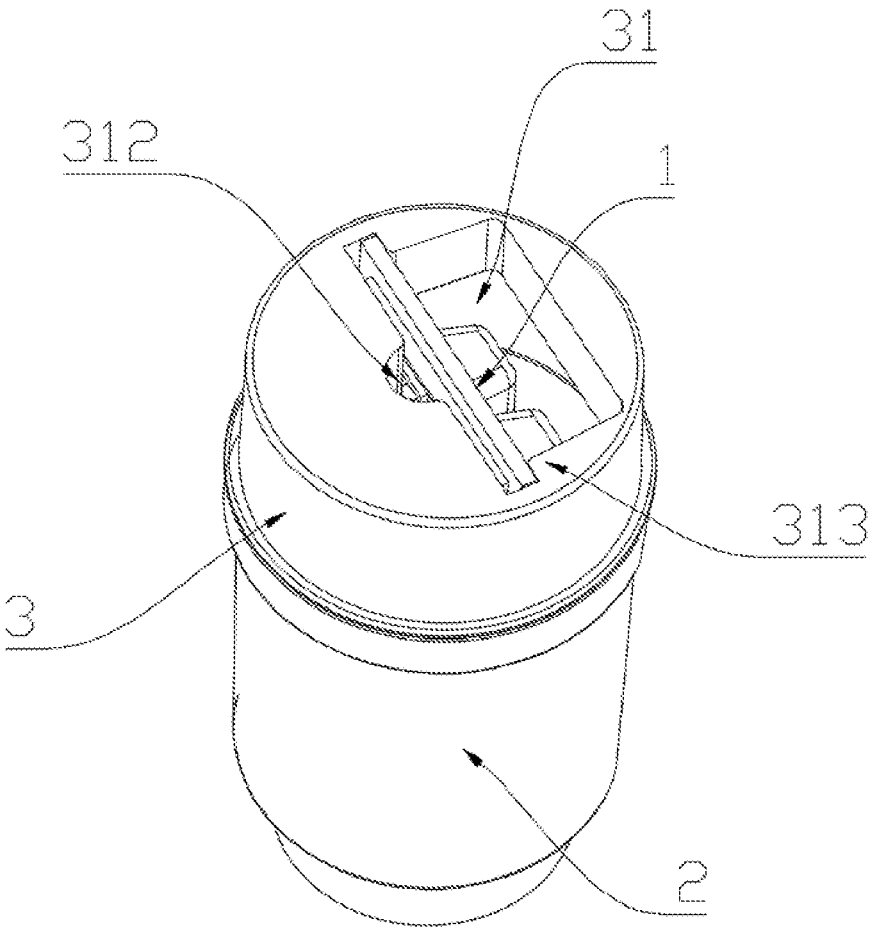
FIG. 2 is a stereoscopic structural schematic view I of the ice cube removal tool according to the present disclosure.

Reference numbers in figures represent:

1—ice cube mold; 11—limiting rib; 200—ice cube receiving and storage chamber;

2—ice cube removal main body; 21—convex ring; 22—ring groove; 23—axial ice cube outlet; 233—radial ice cube outlet; 24—cover lid;

3—ice cube twisting part; 31—axial opening; 311—radial opening; 312—ice cube mold outlet hole; 313—limiting step.

DETAILED DESCRIPTION OF EMBODIMENTS

The present disclosure will be described in detail below with reference to the accompanying drawings and embodiments. Each example is provided by way of an explanation of the present disclosure, not a limitation to the present disclosure. In fact, those skilled in the art will recognize that modifications and variations can be made in the present disclosure without departing from the scope or spirit of the present disclosure. For example, features shown or described as part of one embodiment may be used in another embodiment to produce yet another embodiment. Therefore, it is intended that the present disclosure includes such modifications and variations as come within the scope of the appended claims and their equivalents.

In the description of the present disclosure, the orientations or positional relationships indicated by the terms "longitudinal", "transverse", "upper", "lower", "front", "rear", "left", "right", "vertical", "horizontal", "top", "bottom", etc. are based on the orientations or positional relationships shown in the drawings, and are only to describe the present disclosure and do not require that the present disclosure must be constructed and operated in a specific orientation, so they cannot be understood as limitations to the present disclosure. The terms "linked", "connected" and "arranged" used in the present disclosure should be understood in a broad sense, for example, it can be fixedly connected or detachably connected, it can be directly connected or indirectly connected through an intermediate component, and it also can be a cable connection, a radio connection or a wireless communication signal connection. Those of ordinary skill in the art can understand the specific meanings of the above terms in the present disclosure according to specific situations.

One or more examples of the present disclosure are illustrated in the accompanying drawings. The detailed description uses numerical and letter designations to refer to features in the drawings. Similar or like reference signs in the drawings and descriptions have been used to refer to similar or like parts of the present disclosure. As used herein, the terms "first", "second", "third", etc. are used interchangeably to distinguish one member from another and are not intended to denote the location or importance of individual members.

As shown in FIGS. 1 to 7, an ice cube removal tool includes an ice cube removal main body 2 for containing an ice cube mold 1, the ice cube removal main body 2 is provided with an ice cube twisting part 3 capable of being turned relative to the ice cube removal main body 2, the ice cube removal main body 2 and the ice cube twisting part 3 are partially limited and fixed to the ice cube mold 1 respectively, wherein during the process of removing ice cubes, the ice cube twisting part 3 is turned to twist and deform the ice cube mold 1 and allow the ice cubes to be removed. In the technical solution, the ice cube removal tool limits two ends of the ice cube mold 1 through the ice cube removal main body 2 and the ice cube twisting part 3 respectively, the ice cube removal main body 2 and the ice cube twisting part 3 produce opposite torsion by hand to twist and deform the ice cube mold 1, thereby allowing ice cubes to be removed from an ice cube tray. Popular ice cube molds can refer to ice cube molds disclosed in the patents such as CN308122310S, CN306766809S and CN306676867S and an ice cube mold shown in FIG. 1.

Further, the ice cube removal main body 2 has a cylindrical sidewall. The sidewall defines an ice cube receiving and storage chamber 200 for receiving and storing ice cubes. The ice cube receiving and storage chamber 200 is provided with an ice cube outlet. In the technical solution, the cylindrical sidewall is easy to hold and facilitates turning of the ice cube mold 1 therein, and the structure is more reasonable and simpler. The ice cubes removed from the ice cube mold 1 are temporarily received and stored in the ice cube receiving and storage chamber 200 and then poured out of the ice cube removal main body 2 through the ice cube outlet, and can be directly poured into drinking cups.

Figure 3:
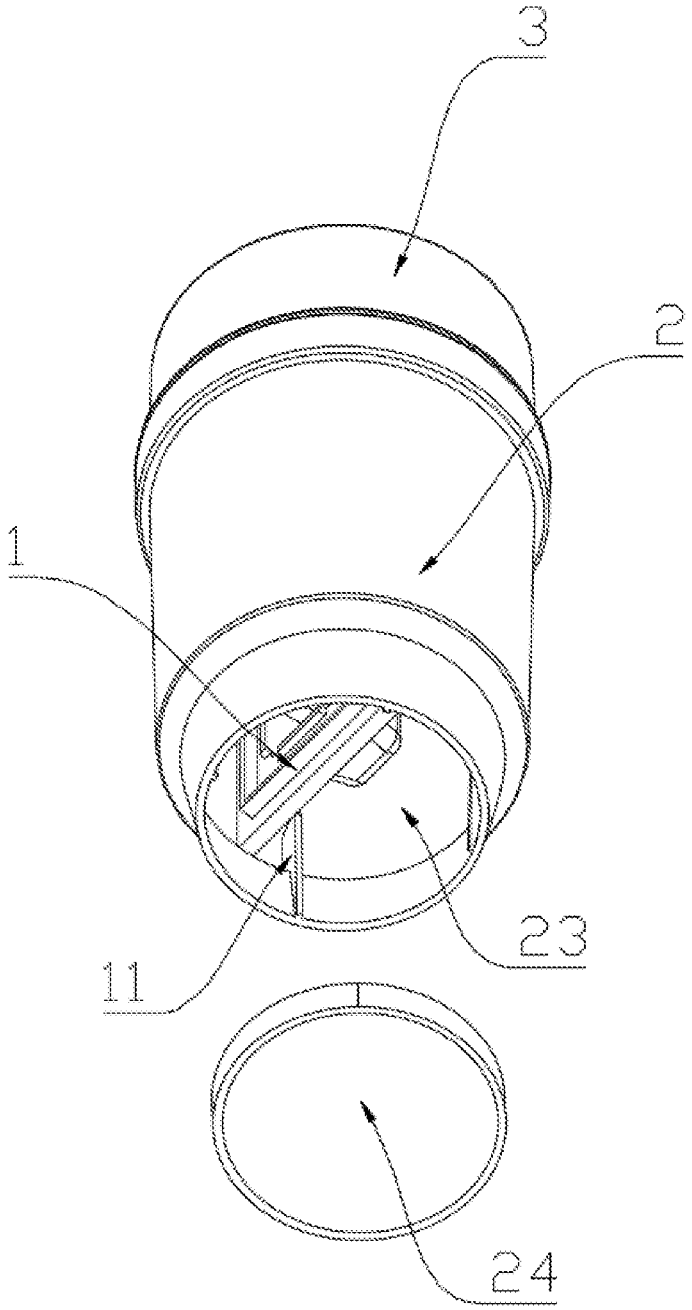
FIG. 3 is an exploded structural schematic view II of the ice cube removal tool according to the present disclosure.
Figure 4:
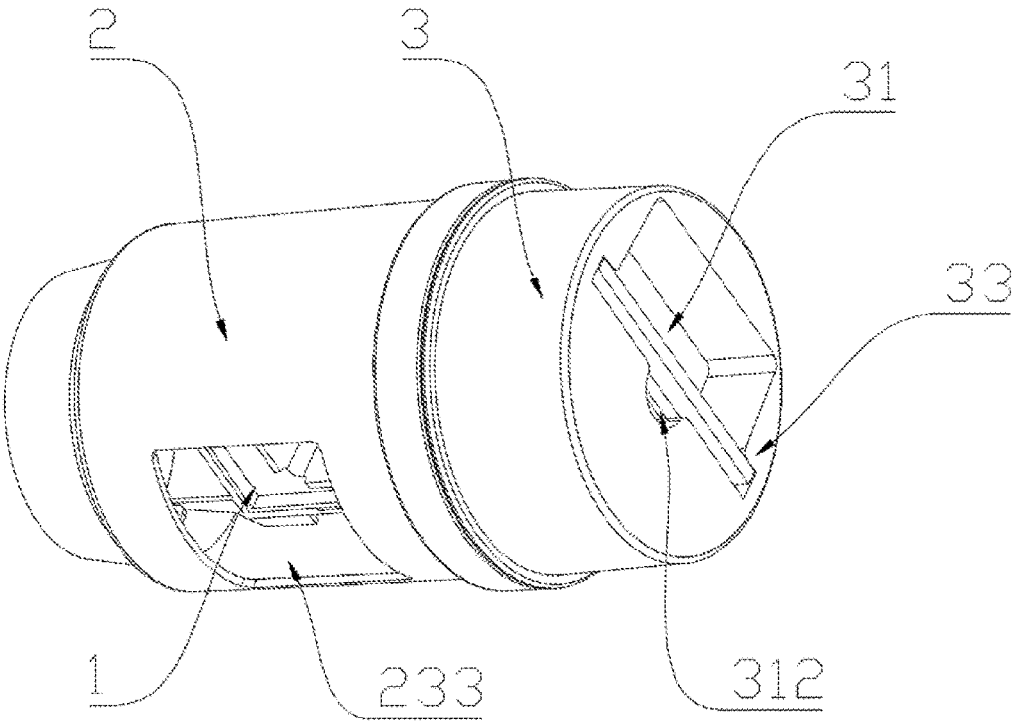
FIG. 4 is a stereoscopic structural schematic view II of the ice cube removal tool according to the present disclosure.
Figure 5:
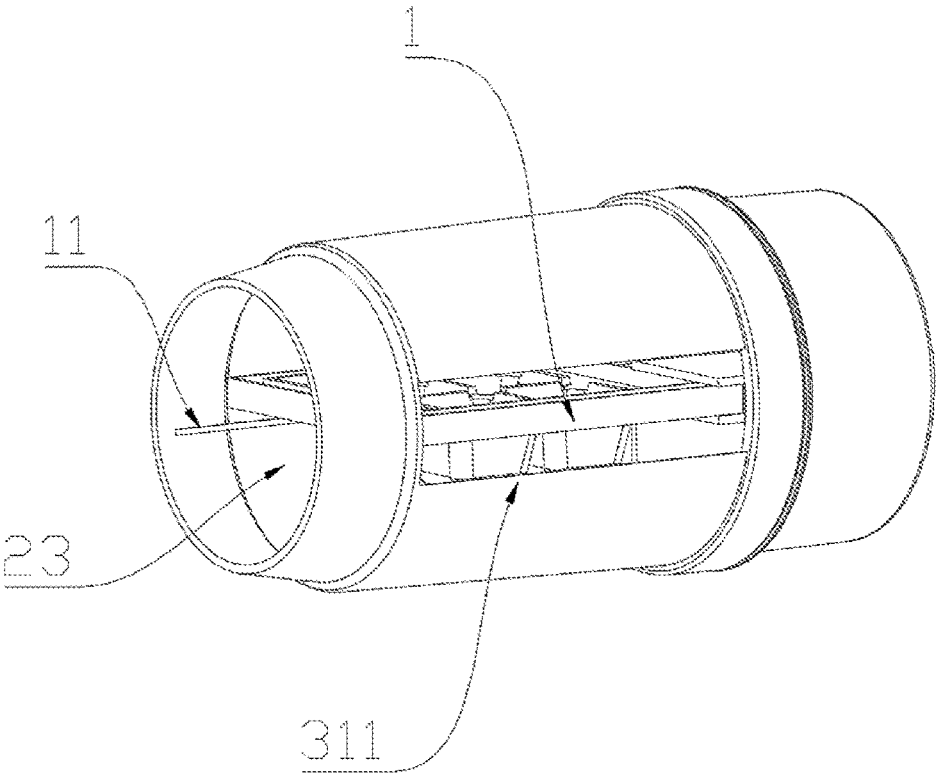
FIG. 5 is a stereoscopic structural schematic view III of the ice cube removal tool according to the present disclosure.
Figure 6:
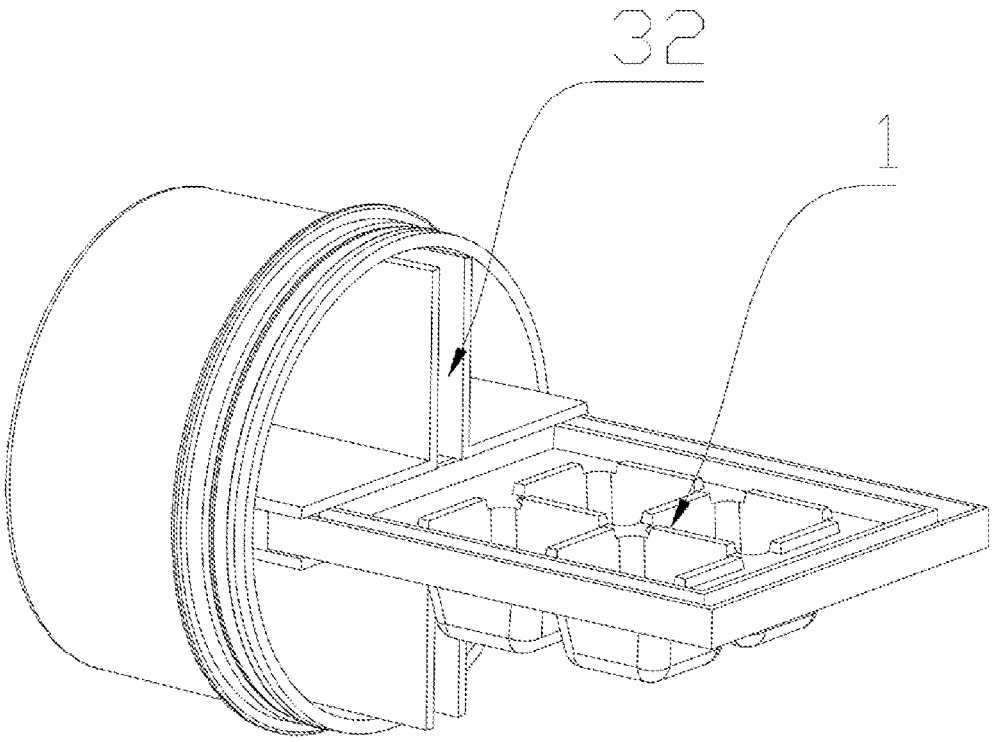
FIG. 6 is a stereoscopic structural schematic view of a limiting groove structure of the ice cube removal tool according to the present disclosure.
Figure 7:
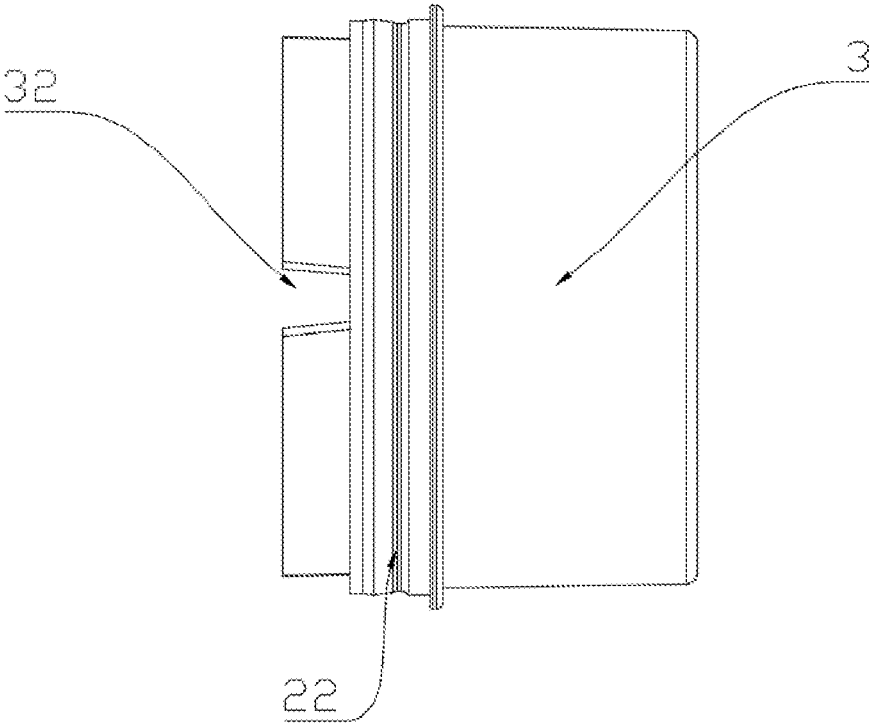
FIG. 7 is a side view of an ice cube twisting part of the ice cube removal tool according to the present disclosure.

Further, the position of the ice cube outlet can refer to two examples in FIG. 3 and FIG. 4. The ice cube outlet is formed on the bottom side of the ice cube receiving and storage chamber 200 or the circumferential side of the ice cube receiving and storage chamber 200. The two examples represent two ice cube pour-out modes. Correspondingly, refer to FIG. 3, a cover lid 24 can be arranged to close the ice cube outlet so that the ice cube receiving and storage chamber 200 can be used as an ice cube storage tool.

Further, the ice cube removal main body 2 is at least partially limited and fixed to a bottom end of the ice cube mold 1, and the ice cube twisting part 3 is at least partially limited and fixed to a top end of the ice cube mold 1. In the technical solution, to make the twisted effect of the ice cube mold 1 more obvious, the most suitable positions, limiting the ice cube mold 1, of the ice cube removal main body 2 and the ice cube twisting part 3 are two ends thereof. Based on this, the ice cube removal main body 2 is provided with limiting ribs 11 corresponding to the bottom end of the ice cube mold 1, and the ice cube removal main body 2 twists the ice cube mold 1 through the limiting ribs 11 to deform the ice cube mold 1. The four limiting ribs 11 are uniformly and symmetrically distributed on the ice cube removal main body 2 so that the ice cube mold 1 can be limited and fixed by the ice cube removal main body 2 when turned by a quarter of a circle at most and then can be twisted and deformed, thereby being more labor-saving in the operating process.

The ice cube twisting part 3 limits the ice cube mold 1 in two examples. Example 1 refers to FIG. 1. The ice cube twisting part 3 is provided with an axial opening 31, the ice cube mold 1 is placed into the ice cube removal main body 2 through the axial opening 31, a limiting step 313 corresponding to the edge of the ice cube mold 1 is formed in the axial opening 31, and the ice cube twisting part 3 can twist the ice cube mold 1 through the limiting step 313 to deform the ice cube mold 1. Example 2, the ice cube twisting part 3 is provided with limiting grooves 32 corresponding to the edge of the ice cube mold 1, the ice cube removal main body 2 is provided with a radial opening 311, the ice cube mold 1 is placed into the ice cube removal main body 2 through the radial opening 311, and after the ice cube mold 1 is placed into the ice cube removal main body 2 through the radial opening 311, the ice cube twisting part 3 twists the ice cube mold 1 through the limiting grooves 32 to deform the ice cube mold 1. Further, refer to FIG. 6 and FIG. 7, the two limiting grooves 32 are arranged on the ice cube twisting part 3 in a cross-shaped mode, groove openings of the limiting grooves 32 at least partially extend to the positions aligned with the radial opening 311, the ice cube mold 1 can be directly mounted into the limiting grooves 32 through the radial opening 311, and the ice cube mold 1 can be more easily aligned with the mounting position through the two flared-out limiting grooves 32.

In summary, in the present disclosure, as for the opening for placing the ice cube mold 1 and the ice cube outlet for taking out ice cubes, the opening can be arranged as the radial opening 311 or the axial opening 31, the ice cube outlet can be formed on the bottom side or the circumferential side, the ice cube outlet is an axial ice cube outlet 23 when formed on the bottom side and is a radial ice cube outlet 233 when formed on the circumferential side. A designer can provide at least three examples according to the actual condition, referring to FIG. 1, FIG. 4 and FIG. 5.

Further, an ice cube mold outlet hole 312 is formed in the axial opening 31 so that a user can take out the ice cube mold 1 with a finger.

Further, a convex ring 21 and a ring groove 22, which correspond with each other, are arranged between the ice cube twisting part 3 and the ice cube removal main body 2 for connection, and the ice cube twisting part 3 and the ice cube removal main body 2 are turned through the convex ring 21 and the ring groove 22. It is worth noting that the positions of the convex ring 21 and the ring groove 22 are interchangeable, of which the same principle should be covered by the scope of the technical solution.

The foregoing is merely a preferred embodiment of the present disclosure and is not intended to limit the present disclosure which may be subject to various modifications and variations to those skilled in the art. Any modification, equivalent replacement, improvement, etc. made within the spirit and principles of the present disclosure should be included in the scope of protection of the present disclosure.

What is claimed is:

1. An ice cube removal tool, comprising an ice cube removal main body for containing an ice cube mold, the ice cube removal main body being provided with an ice cube twisting part capable of being turned relative to the ice cube removal main body, the ice cube removal main body and the ice cube twisting part being partially limited and fixed to the ice cube mold respectively, wherein the ice cube twisting part can be turned to twist and deform the ice cube mold and allow the ice cubes to be removed during a process of removing ice cubes;

wherein the ice cube removal main body is at least partially limited and fixed to a bottom end of the ice cube mold;

wherein the ice cube removal main body is provided with a radial opening, and the ice cube mold is placed into the ice cube removal main body through the radial opening.

2. The ice cube removal tool according to claim 1, wherein the ice cube removal main body is provided with an ice cube receiving and storage chamber for receiving and storing the removed ice cubes.

3. The ice cube removal tool according to claim 2, wherein the ice cube receiving and storage chamber is provided with an ice cube outlet, and the removed ice cubes are poured out from the ice cube outlet.

4. The ice cube removal tool according to claim 3, wherein the ice cube outlet is an axial ice cube outlet which is formed on a bottom side of the ice cube receiving and storage chamber.

5. The ice cube removal tool according to claim 4, wherein a caliber of the axial ice cube outlet of the ice cube removal main body is less than the width of the ice cube mold, thereby preventing the ice cube mold from coming out of the axial ice cube outlet.

6. The ice cube removal tool according to claim 5, wherein the axial ice cube outlet of the ice cube removal main body is necked down.

7. The ice cube removal tool according to claim 3, wherein a corresponding cover lid is arranged on the ice cube outlet.

8. The ice cube removal tool according to claim 3, wherein the ice cube outlet is a radial ice cube outlet which is formed on a circumferential side of the ice cube receiving and storage chamber.

9. The ice cube removal tool according to claim 3, wherein the ice cube removal main body has a cylindrical sidewall.

10. The ice cube removal tool according to claim 1, wherein the ice cube twisting part is at least partially limited and fixed to a top end of the ice cube mold.

11. The ice cube removal tool according to claim 1, wherein a convex ring and a ring groove, which correspond with each other, are arranged between the ice cube twisting part and the ice cube removal main body for connection, and the ice cube twisting part and the ice cube removal main body are turned through the convex ring and the ring groove.

12. The ice cube removal tool according to claim 1, wherein the ice cube removal main body is provided with limiting ribs corresponding to the bottom end of the ice cube mold, and the ice cube removal main body twists the ice cube mold through the limiting ribs to deform the ice cube mold.

13. The ice cube removal tool according to claim 12, wherein the four limiting ribs are uniformly and symmetrically distributed on the ice cube removal main body.

14. The ice cube removal tool according to claim 1, wherein the ice cube twisting part is provided with limiting grooves corresponding to the edge of the ice cube mold, and when the ice cube mold is placed into the ice cube removal main body through the radial opening, the ice cube twisting part twists the ice cube mold through the limiting grooves to deform the ice cube mold.

15. The ice cube removal tool according to claim 14, wherein the two limiting grooves are arranged on the ice cube twisting part in a cross-shaped mode.

16. The ice cube removal tool according to claim 15, wherein groove openings of the limiting grooves at least partially extend to positions aligned with the radial opening, and the ice cube mold can be directly mounted into the limiting grooves through the radial opening.

* * * * *